US006058635A

United States Patent [19]

Morris

[11] Patent Number: 6,058,635

[45] Date of Patent: May 9, 2000

[54] DOOR FRAME WITH INTEGRATED EXIT SIGNAGE

[76] Inventor: Raymond T. Morris, 908 Excelsior Ave., Croydon, Pa. 19021

[21] Appl. No.: 09/028,862

[22] Filed: Feb. 12, 1998

[51] Int. Cl.[7] ..... G09F 13/04

[52] U.S. Cl. ..... 40/570; 40/544; 52/28

[58] Field of Search ..... 362/100, 145, 362/471; 52/28, 205, 211, 656.4; 40/570, 605, 544

[56] References Cited

U.S. PATENT DOCUMENTS

| | | | |
|---|---|---|---|
| 1,191,783 | 7/1916 | Harsh | 362/100 |
| 2,709,745 | 5/1955 | Sundt | 362/100 |
| 2,734,123 | 2/1956 | Gerber | 362/145 |
| 3,212,080 | 10/1965 | Gurian et al. | 40/544 X |
| 3,303,616 | 2/1967 | Brown | 52/28 X |
| 3,352,074 | 11/1967 | Schwartzberg | 52/211 |
| 3,998,025 | 12/1976 | Nestroy | 52/28 X |
| 4,791,740 | 12/1988 | Ferrari | 52/211 X |
| 4,887,195 | 12/1989 | Donelan . | |
| 5,448,843 | 9/1995 | Schwartz | 40/570 |
| 5,499,171 | 3/1996 | Simpson et al. | 362/100 |
| 5,526,251 | 6/1996 | Andre et al. . | |
| 5,581,230 | 12/1996 | Barrett | 362/100 |
| 5,671,997 | 9/1997 | Potts . | |
| 5,775,016 | 7/1998 | Chien | 40/544 |

*Primary Examiner*—Joanne Silbermann
*Attorney, Agent, or Firm*—Henderson & Sturm LLP

[57] ABSTRACT

A door frame construction 10 including a hollow generally inverted U-shaped door frame member 20 having a pair of side channels 21, 22, and an overhead channel 23 provided with a plurality of illuminated exit sign units 12 and an emergency light unit 13. The exit sign units 12 and the emergency light unit 13 are electrically connected to one another by electrical wiring 101 disposed within the hollow door frame member 20 to provide integrated exit signage into the door frame member 20.

3 Claims, 2 Drawing Sheets

DOOR FRAME WITH INTEGRATED EXIT SIGNAGE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of exit signs in general, and in particular to exit signage that is integrated into a hollow door frame.

2. Description of Related Art

As can be seen by reference to the following U.S. Pat. Nos. 4,887,195; 5,448,843; 5,526,251; and 5,671,997, the prior art is replete with myriad and diverse exit sign constructions.

While all of the aforementioned prior art constructions are more than adequate for the basic purpose and function for which they have been specifically designed, they are uniformly deficient with respect to their failure to provide a simple, efficient, and practical way of incorporating exit signage into a hollow metal door frame member to reduce the cost of installing multiple independent exit signs in a building and to minimize, if not eliminate the repair and/or replacement of emergency exit signage in a high risk environment, such as school or prison where vandalism is a well recognized fact of life.

As a consequence of the foregoing situation, there has existed a longstanding need for a new and improved type of door frame construction wherein emergency exit signage is incorporated into the hollow interior of a door frame member for both economic and safety reasons and the provision of such a construction is a stated objective of the present invention.

BRIEF SUMMARY OF THE INVENTION

Briefly stated, the door frame construction that forms the basis of the present invention comprises a hollow framework unit having a plurality of exit sign units, an emergency lighting unit, and a power supply unit all built into the hollow framework unit.

As will be explained in greater detail further on the specification, the exit sign units are deployed on the front faces of the two side channels and an overhead channel which form the door frame member. The emergency light unit is deployed on the bottom face of the overhead channel and provided with a switch that is engageable by a door suspended within the framework unit.

In addition, a power source unit is contained within the framework unit and includes both a hardwired system and a battery pack back-up system to energize the exit sign units and the emergency light unit, while eliminating the need for external or exposed wiring as would be required with conventional emergency exit sign arrangements.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
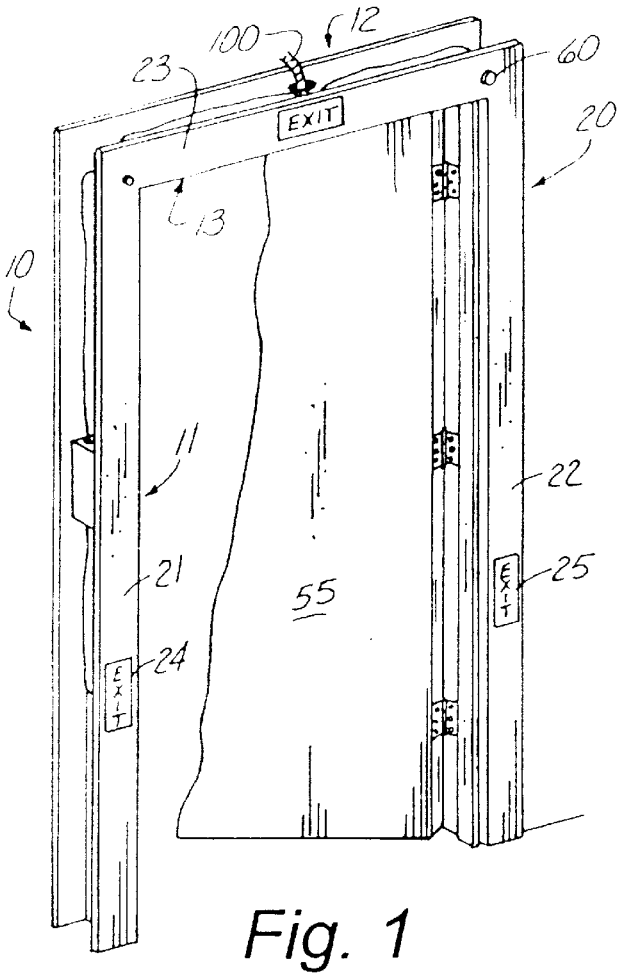
FIG. 1 is a perspective view of the door frame construction of this invention installed in a doorway.

As can be seen by reference to the drawings, and in particularly to FIG. 1, the door frame construction that forms the basis of the present invention is designated generally by the reference number 10. The door frame construction 10 comprises in general a hollow framework unit 11, a plurality of exit sign units 12, an emergency light unit 13, and a power supply unit 14. These units will now be described in seriatim fashion.

As shown in FIG. 1, the hollow framework unit 11 comprises a conventional hollow metal door frame member 20 having a generally inverted U-shaped configuration including a pair of side channels 21 and 22 that are connected to one another by an overhead door lintel channel 23.

Figure 6:
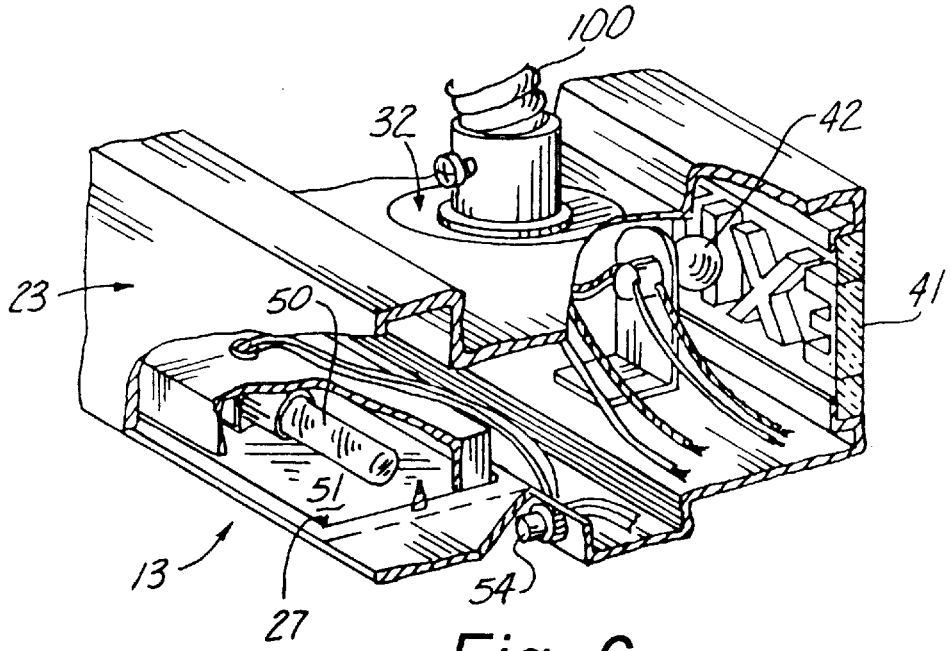
FIG. 6 is an isolated detail view of the emergency lighting feature of the door frame construction.

In addition, each of the side channels 21, 22 and the lintel channel 23 are provided with generally uniform rectangular apertures 24, 25 and 26, respectively. As shown in FIG. 6, the lintel channel 23 is further provided with an elongated rectangular aperture 27 whose purpose and function will be described in greater detail further on in the specification.

Figure 4:
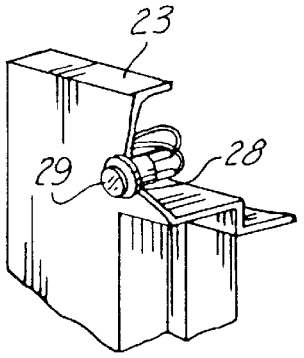
FIG. 4 is an isolated detail view of the remote test button feature.

As can also be seen by reference to FIGS. 1 and 4, the pair of side exit sign apertures 24 and 25 are disposed on the lower portion of the side channels 21 and 22 and the overhead exit sign aperture 26 is centrally disposed on the lintel channel 23 in accordance with code requirements. Furthermore, a discrete aperture 28 is disposed on the upper portion of the door frame member 20 to receive a test button 29 for testing the power supply unit 14. The test button is disposed at a sufficient height to preclude usage by most schoolchildren.

Figure 2:
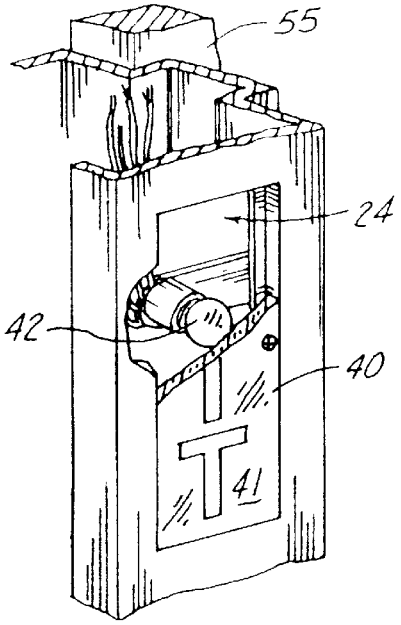
FIG. 2 is an isolated detail view of one of the side mounted exit signs.
Figure 3:
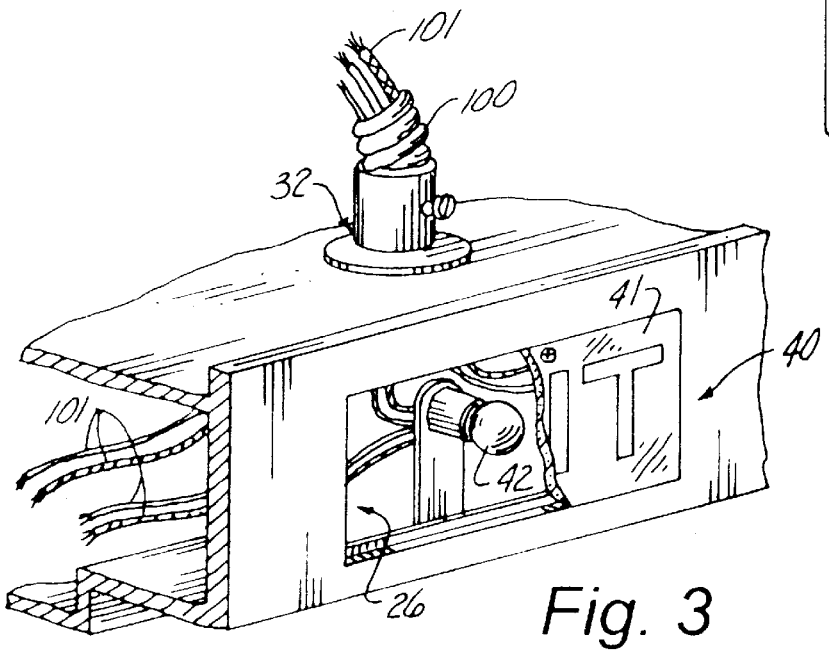
FIG. 3 is an isolated detail view of the top mounted exit sign.

Turning now to FIGS. 2, 3, and 6, it can be seen that each of the plurality of exit sign units 12 comprise an exit sign member 40 fabricated from a high impact plastic lens 41. A light source 42 is disposed directly behind the lens 41, wherein the light source 42 comprises a plurality of light elements, such as a 12V EM and a 12V NOR, or the like.

Figure 5:
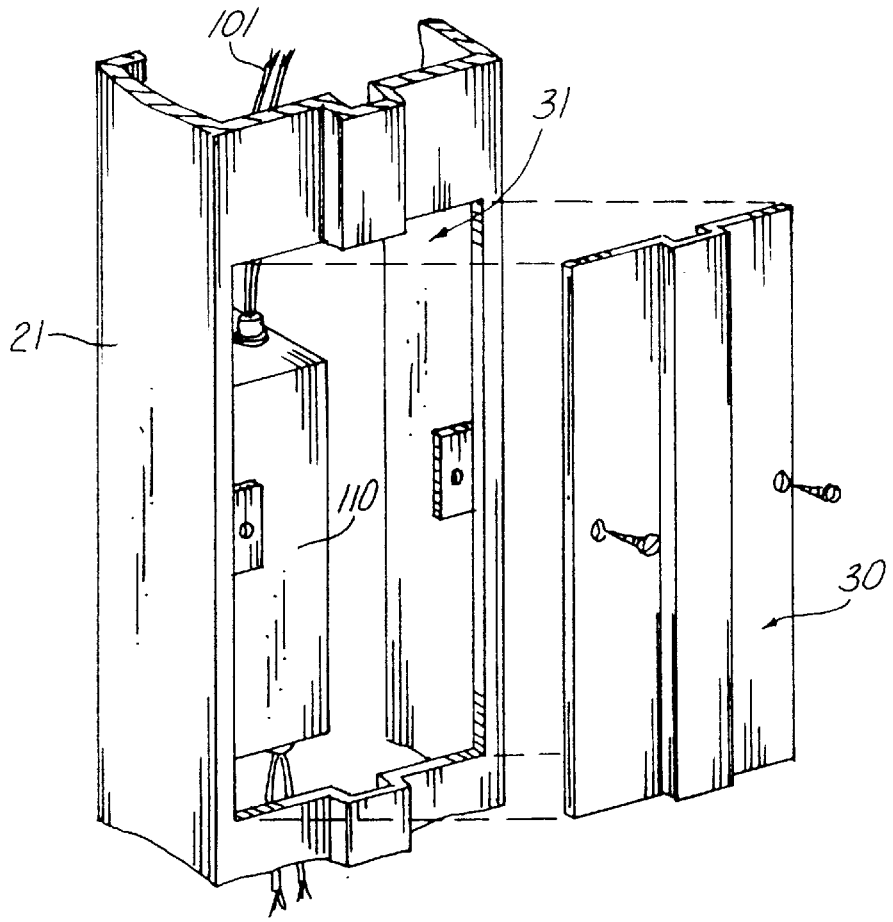
FIG. 5 is an isolated detail view of one of the access panels.

As can also be seen by reference to FIGS. 3, 5, and 6, the door frame member is further provided with an access panel 30 dimensioned to be received in a panel opening 31 formed in one of the side channels 21 or 22 of the door frame member 20. In addition, the overhead lintel channel 23 is provided with a punch out aperture 32 wherein the power supply unit 14 may be connected directly to the building wiring, designated generally as 100 without the need of armored cables (not shown) being connected to the accessible exterior of the door frame member 20, wherein the wiring would be accessible to vandals and other unauthorized tampering.

As can best be seen by reference to FIG. 6, the emergency lighting system 13 comprises a switch actuated illumination source 50 positioned behind a clear plastic lens 51 which is received in the elongated aperture 27 formed in the bottom of the lintel channel 23. In addition, the illumination source 50 is electrically coupled to a spring loaded switch 54 which is designed to be held in the normally closed position by contact with a conventional door 55 suspended within the door frame member 20 such that the illumination source 50 is only energized when the door 55 is disposed in the open position depicted in FIG. 1.

As shown in FIGS. 2, 3, 5, and 6, the power supply unit 14 is both hard wired to the building power supply 100 via conventional electrical wiring 101 and provided with a battery pack back-up system 110 in the event that the normal building power supply 100 is interrupted by fire or other natural calamity. In addition, as shown in FIG. 1, this invention also contemplates the inclusion of an audible alarm element 60 being incorporated into the door frame member 20 to assist individuals in locating the doorway in heavy smoke conditions.

It should further be noted at this juncture that due to the integrated signage feature of this invention, several significant economic and safety benefits are realized. First and foremost of all being the provision of integrated emergency lighting and signage being incorporated into a conventional building structural component that eliminates the need for independently mounted and wired emergency exit lights.

The next significant benefit is that by virtue of the integration of the signage into a metal door frame, the likelihood of vandalism and the attendant cost of repair and replacement of the illuminated signage is virtually eliminated. Last, but not least, this construction complies with all safety code requirements and eliminates the need for armor clad exposed wiring to the multiple individual emergency light fixtures currently deemed mandatory in all commercial, educational, and health care facilities.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A door frame construction with integrated exit signage consisting of:

a door frame unit including a generally inverted U-shaped hollow door frame member including a pair of side channels and an overhead channel each having a front face disposed in the same vertical plane wherein each of the front faces of said channels are provided with generally rectangular apertures wherein the apertures in said side channels are formed on the lower portion of the front faces of said side channels; and a plurality of exit sign units wherein each exit sign unit includes an exit sign member having a lens and an illumination source disposed in proximity to said lens wherein each of said channels is provided with one of said plurality of exit sign units which are dimensioned to be received in said generally rectangular apertures in the front faces of the door frame member.

2. A door frame construction with integrated exit signage consisting of:

a door frame unit including a generally inverted U-shaped hollow door frame member including a pair of side channels and an overhead channel each having a front face disposed in the same vertical plane wherein each of the front faces of said channels are provided with at least one generally rectangular aperture and one of the channels is provided with a pair of generally rectangular apertures disposed generally perpendicular to one another wherein the apertures in said side channels are formed on the lower portion of the front face of said side channels;

a plurality of exit sign units wherein each exit sign unit includes an exit sign member having a lens and an illumination source disposed in proximity to said lens wherein each of said channels is provided with one of said plurality of exit sign units which are dimensioned to be received in said at least one generally rectangular aperture in the front faces of the door frame member; and, an emergency light unit disposed in the one of the channels provided with a pair of rectangular apertures and including a switch activated illumination source disposed proximate to one of said pair of generally rectangular apertures.

3. A door frame construction with integrated exit signage consisting of:

a door frame unit including a generally inverted U-shaped hollow door frame member including a pair of side channels and an overhead channel each having a front face disposed in the same vertical plane wherein each of the front faces of said channels are provided with at least one generally rectangular aperture and one of the channels is provided with a pair of generally rectangular apertures disposed generally perpendicular to one another, wherein the apertures in said side channels are formed on the lower portion of the front face of said side channels;

a plurality of exit sign units wherein each exit sign unit includes an exit sign member having a lens and an illumination source disposed in proximity to said lens wherein each of said channels is provided with one of said plurality of exit sign units which are dimensioned to be received in said at least one generally rectangular aperture in the front faces of the door frame member; and an emergency light unit disposed in the one of the channels provided with a pair of rectangular apertures and including a switch activated illumination source disposed proximate to one of said pair of generally rectangular apertures wherein the switch actuated illumination source includes a switch which is positioned to be engaged by a conventional door suspended within said door frame member.

* * * * *